US006793298B2

(12) United States Patent
Delph

(10) Patent No.: US 6,793,298 B2
(45) Date of Patent: Sep. 21, 2004

(54) FURNITURE UNIT USING DUAL SLIDER MECHANISM

(75) Inventor: Richard Eugene Delph, Pulaski, VA (US)

(73) Assignee: Pulaski Furniture Corporation, Pulaski, VA (US)

( * ) Notice: Subject to any disclaimer, the term of this patent is extended or adjusted under 35 U.S.C. 154(b) by 15 days.

(21) Appl. No.: 10/285,517

(22) Filed: Nov. 1, 2002

(65) Prior Publication Data

US 2004/0027039 A1 Feb. 12, 2004

Related U.S. Application Data

(60) Provisional application No. 60/402,062, filed on Aug. 9, 2002.

(51) Int. Cl.[7] ..... A47F 3/00; A47B 88/04

(52) U.S. Cl. ..... 312/139.2; 312/334.28

(58) Field of Search ..... 312/334.23, 334.24, 312/334.25, 334.26, 334.27, 334.28, 334.33, 114, 130, 131, 132, 138.1, 139.2, 283, 286, 350; 49/149, 404

(56) References Cited

U.S. PATENT DOCUMENTS

| | | | | | |
|---|---|---|---|---|---|
| 463,932 | A | | 11/1891 | Allison | |
| 637,361 | A | * | 11/1899 | Suters | 312/131 |
| 1,181,331 | A | * | 5/1916 | Metzger | 312/139.2 |
| 1,380,222 | A | * | 5/1921 | Lichtenberg | 312/246 |
| 1,782,819 | A | * | 11/1930 | Hansen | 312/139.2 |
| 2,475,284 | A | * | 7/1949 | Houpt | 312/295 |
| 2,565,784 | A | * | 8/1951 | Sheean | 312/286 |
| 3,401,994 | A | * | 9/1968 | Diack | 312/139.2 |
| 4,657,317 | A | * | 4/1987 | Gemma | 312/198 |
| 4,811,518 | A | | 3/1989 | Ladisa | |
| 5,590,940 | A | | 1/1997 | Richard | |
| 5,829,859 | A | | 11/1998 | Cram | |
| 6,113,198 | A | | 9/2000 | Hommes | |

FOREIGN PATENT DOCUMENTS

| | | | | |
|---|---|---|---|---|
| DE | 894001 | * | 10/1953 | 312/139.2 |
| FR | 692475 | * | 11/1930 | 312/334.28 |

* cited by examiner

*Primary Examiner*—James O. Hansen
(74) *Attorney, Agent, or Firm*—McGuireWoods LLP

(57) ABSTRACT

A furniture unit having a dual slider mechanism with an outer carriage and an inner carriage. Both the outer carriage and the inner carriage may include stoppers at opposing ends. A bearing or wheel assembly is provided. The bearing or wheel assembly may be positioned between the side rails of the outer carriage and the inner carriage, and which allows the inner and outer carriages to freely slide. The sliding mechanism may be used with a furniture unit in order to allow a door to open in a first open position or a second closed position or remain in a closed center position. A locking mechanism may be used to lock the door to the frame of the furniture unit.

16 Claims, 9 Drawing Sheets

FURNITURE UNIT USING DUAL SLIDER MECHANISM

CROSS REFERENCE TO RELATED APPLICATIONS

The present application claims priority to provisional U.S. Application Serial No. 60/402,062, filed Aug. 9, 2002, which is incorporated by reference in its entirety herein.

BACKGROUND OF THE INVENTION

1. Field of the Invention

The present invention generally relates to a furniture unit using a dual slider mechanism and, more particularly, to a furniture unit having a slider mechanism which allows a door to open completely in two directions.

2. Background Description

Current furniture units include slider mechanisms that are cumbersome, difficult to manufacture and include many installation pieces. These slider mechanisms are expensive to manufacture and require additional setting pieces when installing on furniture and the like. For example, one known slider mechanism includes three carriages in order to allow movement or sliding of a door or the like in two opposing directions. More specifically, this known system includes a center carriage that is sandwiched between two outer carriages. A bearing system interconnects the three carriages. The use of the center carriage and bearing system required to assembly the three carriage system is both complicated and labor intensive to manufacture and install. This adds to the overall costs of the slider mechanism and, in addition to the overall cost of the furniture unit. Moreover, the installation of this type of slider assembly requires additional setting pieces that further adds to the cost of the overall system. Other problems are also known.

The present invention is directed to overcoming one or more of the problems as set forth above.

SUMMARY OF THE INVENTION

In an aspect of the present invention, a furniture unit includes a frame member having at least two notches and a door slidably mounted between a first open position, a second open position and a center closed position with respect to the frame member. A slider mechanism is mounted between the frame member and the door. The slider mechanism includes a first outer carriage and a first inner carriage, in embodiments, having opposing upstanding side rails and stoppers at opposing ends. The first outer carriage is mounted to one of the frame and the door and the first inner carriage is mounted to the other of the frame and the door. A bearing assembly or wheels is also provided. Stoppers are adapted to prevent the first inner and outer carriages from disengaging when in a first or second extended position.

In embodiments, the first outer carriage and the first inner carriage is mounted to an upper portion of the one of the frame and the door, and a second outer carriage and a second inner carriage is mounted to a bottom portion of the frame and the door. Notches are positioned at the top and the bottom portion of the frame in alignment with the first and second outer carriage and inner carriage.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The present invention is directed to a furniture unit using a dual slider mechanism. The furniture unit may be, for example, a curio furniture unit. It should be understood by those of ordinary skill in the art that other furniture units may also be used with different types of dual slider mechanism having a two carriage system; however, for illustrative purposes the present invention will be described with reference to a curio furniture unit. This should not limit the understanding of the present invention. In embodiments of the present invention, the dual slider mechanism is provided with two carriages thus making it a less complex structure than known sliding mechanisms. The dual slider mechanism of any embodiments shown and described is easy to manufacture and thus reduces manufacturing costs, and requires less setting pieces during the installation on a furniture unit. In the preferred embodiments, the dual slider mechanism avoids the need for a center carriage or rail.

Embodiments of the Present Invention

Figure 1:
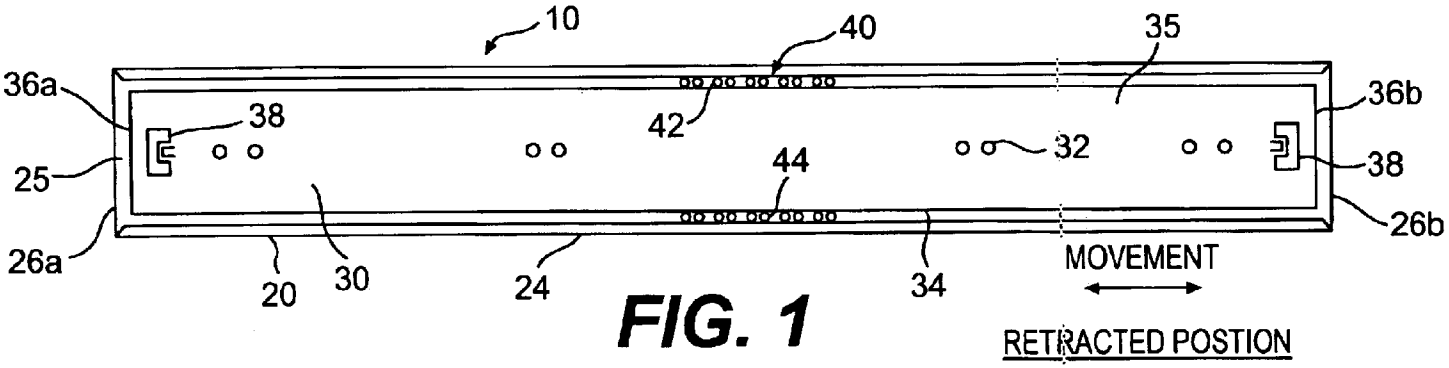
FIG. 1 shows a top view of the dual slider mechanism used with a furniture unit of the present invention.
Figure 2:
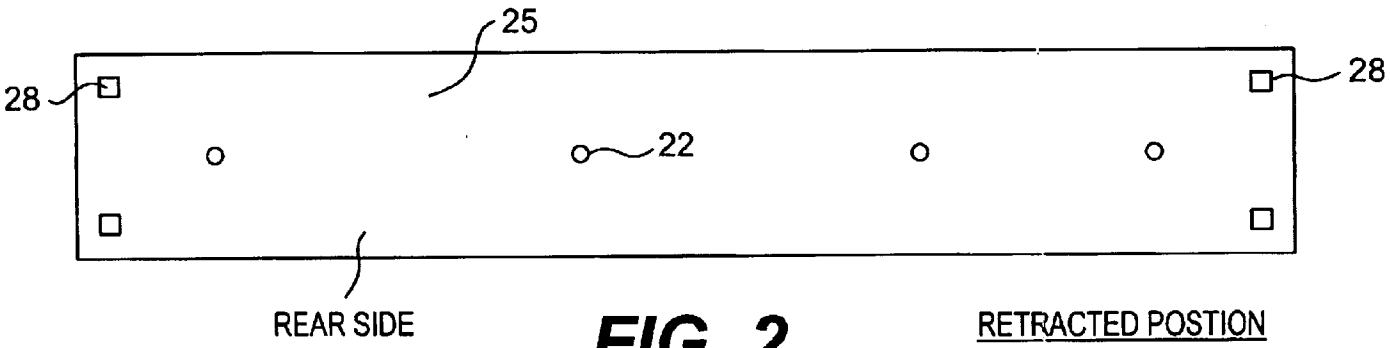
FIG. 2 shows a bottom view of the dual slider mechanism used with a furniture unit of the present invention.

Now referring to FIG. 1, a top view of a first embodiment of the dual slider mechanism used with a furniture unit is shown. The dual slider mechanism is generally depicted as reference numeral 10 and includes an outer rail or carriage 20 and an inner rail or carriage 30. The outer carriage 20 includes holes 22 (FIG. 2) for mounting to opposing surfaces of a curio door or frame or other type of furniture. The outer carriage 20 further includes upstanding side rails 24 and open opposing ends 26*a* and 26*b*. Stoppers 28 are stamped at the opposing ends 26*a* and 26*b* of the outer carriage 20 (as shown in FIG. 2), and preferably into a body portion 25 of the outer carriage 20. In embodiments, the body portion 25 is positioned between the upstanding side rails 24.

Still referring to FIG. 1, the inner carriage 30 is positioned within or between the upstanding side rails 24. The inner carriage 30 includes holes 32 for mounting to opposing surfaces of a curio door or frame or other type of furniture. The inner carriage 30 further includes upstanding side rails 34 and open opposing ends 36*a* and 36*b*. Stoppers 38 are stamped at the opposing ends 36*a* and 36*b* of the inner carriage 30, and preferably into a body portion 35 of the inner carriage 30. In embodiments, the body portion 35 is positioned between the upstanding side rails 34. Both stoppers 28 and 38 face one another, extending inward towards the center of the dual slider mechanism 10. In embodiments, the stoppers 28 and 38 are each a set of two stoppers.

The inner carriage 30 is slidably coupled to the outer carriage 20 via a bearing assembly 40. The bearing assembly 40 includes bearings 42 held within a bearing case or cage 44. The bearings 42 are slidably mounted between the upstanding side rails 24 and 34 of the outer and inner carriages 20 and 30, respectively. The bearing cage 44 includes opposing stopping edges (shown in FIG. 4) that are designed to engage or contact with the stoppers 28 and 38 of both the outer and inner carriages 20 and 30, respectively (as discussed below).

FIG. 2 shows a bottom view of the dual slider mechanism 10 of FIG. 1. In this view, the bottom of the outer carriage 20 is shown and more specifically the body portion 25. The body portion 25 includes holes 22 and stoppers 28 extending in the direction of the upstanding side rails 24.

Figure 3:
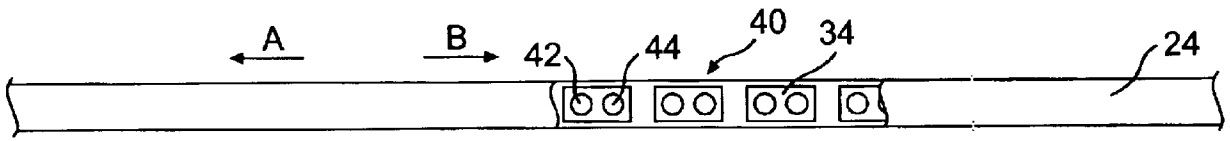
FIG. 3 shows a side view of the dual slider mechanism used with a furniture unit of the present invention.

FIG. 3 shows a side view of the dual slider mechanism 10 of FIG. 1. As seen, the outer carriage 20 includes upstanding side rails 24. A cut away portion of one of the upstanding side rails 24 shows the bearing assembly 40 including the bearings 42 and a portion of the bearing cage 44 positioned between the upstanding side rails 24 and 34 of the outer and inner carriages 20 and 30. The bearing assembly 40 allows the inner carriage 20 to slide freely in a first extended direction depicted by arrow "A" and a second, opposing extended direction depicted by arrow "B". In this manner, the inner carriage 30 can freely slide in opposing directions. In FIG. 3, much like FIGS. 1 and 2, the inner carriage 20 is in the retracted position.

Figure 4:
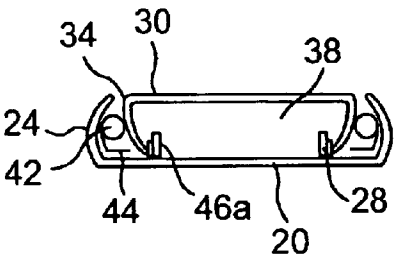
FIG. 4 shows either a front (or rear) view of the dual slider mechanism used with a furniture unit of the present invention.

FIG. 4 shows a front (or rear) view of the dual slider mechanism 10 of FIG. 1. In this embodiment, the inner carriage 20 is in either in the first extended direction or the second, opposing extended direction. Seen clearly in this view, the upstanding side rails 34 of the inner carriage 30 are nestled between the upstanding side rails 24 of the outer carriage 20. That is, the upstanding side rails 24 and 34 extend towards one another. The bearings 42 are positioned between the upstanding side rails 24 and 34. In the extended position, the stoppers 28 of the outer carriage 20 contact a first stopping edge 46*a* of the bearing assembly 40 and the stoppers 38 of the inner carriage 30 contact the second stopping edge 46*b* of the bearing assembly 40. Alternatively, in the other extended position, the stoppers 28 of the outer carriage 20 contact a stopping edge 46*b* of the bearing assembly 40 and the stoppers 38 of the inner carriage 30 contact the stopping edge 46*a* of the bearing assembly 40. In this manner, the inner carriage 20 is prevented from disengaging (extending off) from the outer carriage 20.

Figure 5:
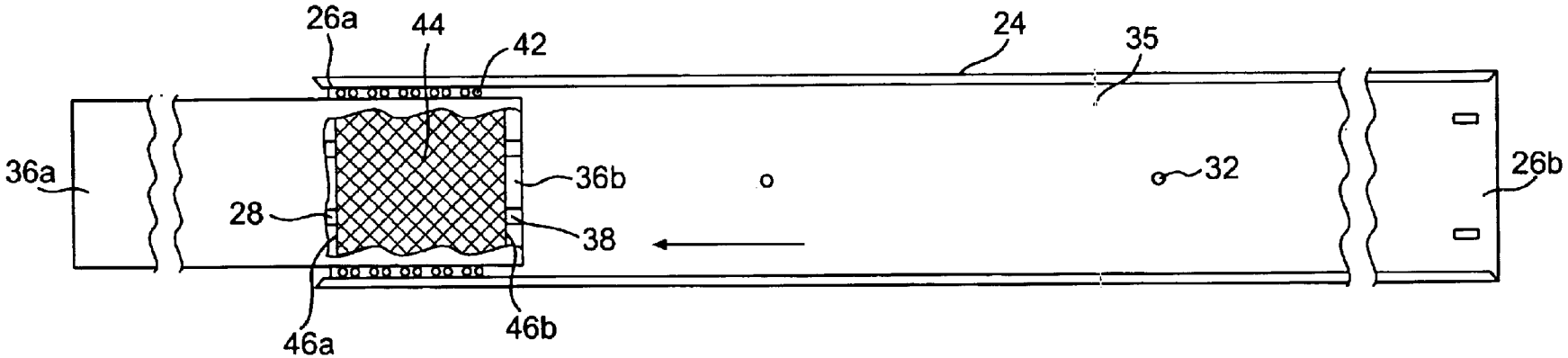
FIG. 5 shows the dual slider mechanism of the present invention in a first open position.
Figure 6:
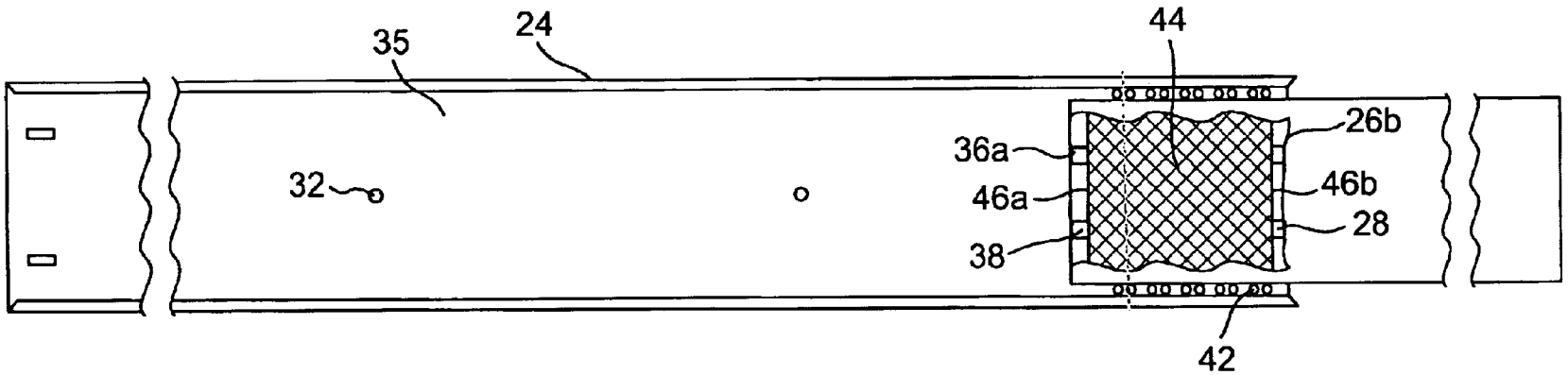
FIG. 6 shows the dual slider mechanism of the present invention in a second open position.

FIG. 5 shows the dual slider mechanism 10 in a first open position and FIG. 6 shows the dual slider mechanism 10 in a second open position. In the position of FIG. 5, the stoppers 28 at the end 26*a* of the outer carriage 20 contact the stopping edge 46*a* of the bearing assembly 40. Also, the stoppers 38 at the end 36*b* of the inner carriage 30 contact the stopping edge 46*b* of the bearing assembly. Similarly, in the position of FIG. 6, the stoppers 28 at the end 26*b* of the outer carriage 20 contact the stopping edge 46*b* of the bearing assembly 40. Also, the stoppers 38 at the end 36*a* of the inner carriage 30 contact the stopping edge 46*a* of the bearing assembly 40.

Figure 7A:
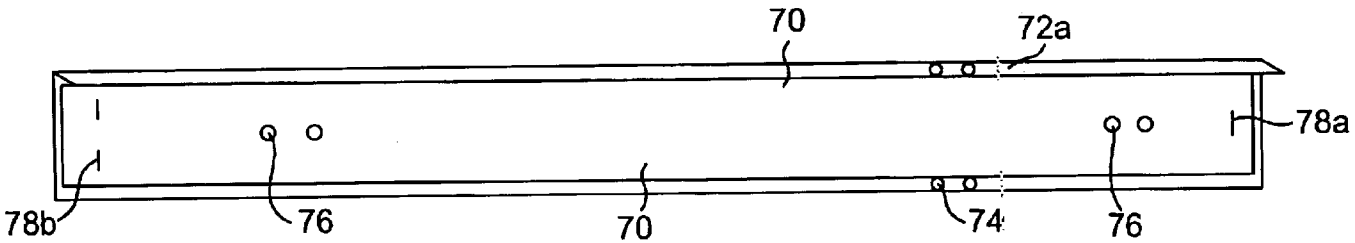
FIGS. 7*a*–7*c* show another dual slider mechanism used with a furniture unit of the present invention.

FIG. 7*a* shows another dual slider mechanism used with the furniture unit of the present invention. In this embodiment, a first carriage 70 is nestled within a second outer carriage 72. The second, outer carriage 72 has upstanding side rails 72*a*. Wheels or bearings 74 may be provided between the inner and outer carriages 70, 72. The slider mechanism is thus telescoping affixed to the frame of the furniture unit and the door of the furniture unit. The first carriage 70 is received within the second carriage, which may be fixed (depending on the mounting position). Mounting holes 76 are provided in the first, inner carriage 70. These same mounting holes are also provided in the second, outer carriage 72 (shown in FIGS. 7*b* and 7*c*). Offset stopping mechanisms 78 are provided on the inner carriage 70 and the outer carriage 72, respectively. In embodiments, other types of conventional stopping mechanism may be used with this embodiment to ensure that the carriages 70, 72 do not disengage.

Figure 7B:
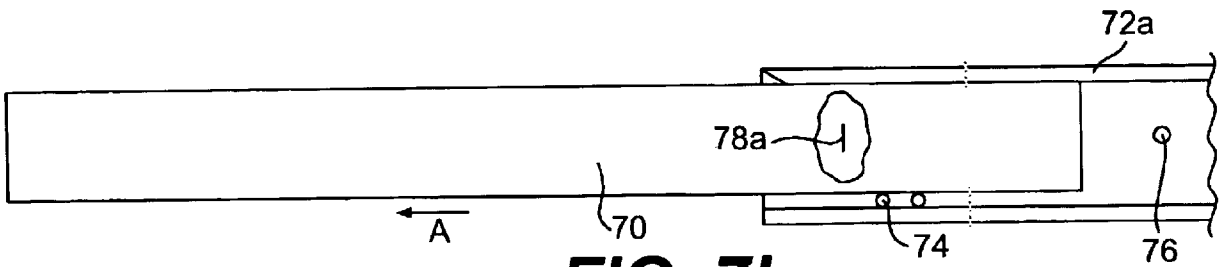
Figure 7C:
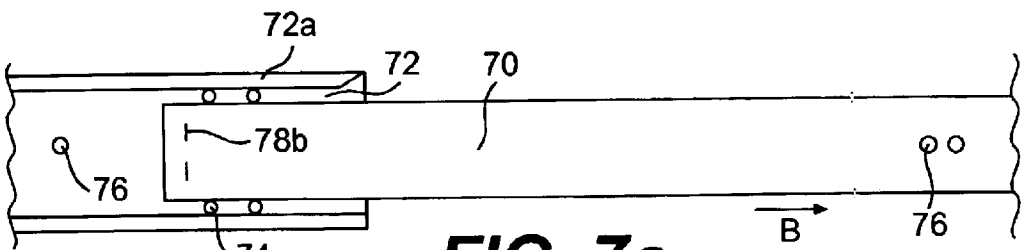

FIGS. 7*b* and 7*c* show the carriages 70 and 72 in extended, opposing positions. In FIG. 7*b*, the inner carriage 70 is extended in the direction of arrow "A". In this extended position, the stoppers 78*a* of both the outer carriage 72 and the inner carriage 70 engage with one another. This ensures that the inner carriage 70 will not disengage from the outer carriage 72. The wheels or bearings 74 allow for a smooth sliding mechanism between the two carriages 70, 72. FIG. 7*c* shows the inner carriage extended in the position along arrow "B". Further, FIG. 7*c* shows the mounting holes 76 of the outer carriage 72. As shown, the stoppers 78*a* and 78*b* are offset from one another such that they will not interfere with the movement of either of the carriages 70, 72 during extension or movement thereof. These stoppers are designed to stop the carriages 70, 72 at an end of travel. The stoppers 78*a* and 78*b* may be stamped into the carriages 70 and 72, in embodiments. It should be recognized that either of the carriages may be stationary while the other carriage is extended, and that FIGS. 7*b* and 7*c* are provided for illustrative purposes to show one embodiment of the extension of the carriages.

Figure 8A:
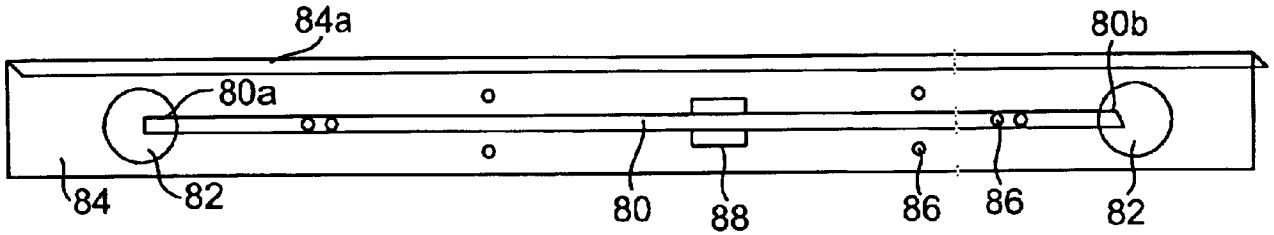
FIGS. 8*a*–8*c* show still another dual slider mechanism used with a furniture unit of the present invention.

FIG. 8*a* shows still another dual slider mechanism used with a furniture unit of the present invention. In this embodiment, an inner carriage 80 includes ends 80*a* and 80*b*. The ends 80*a* and 80*b* are rotatably mounted to wheels 82 or the like. The wheels 82 are mounted within upstanding rails 84*a* of an outer carriage 84. The outer carriage 84 may be mounted to the frame of the furniture unit and the inner carriage 80 may be mounted to the door of the furniture unit via mounting holes 86. Of course, the inner carriage 80 may be mounted to the frame of the furniture unit and the outer carriage 84 may be mounted to the door of the furniture unit. In either application, the dual slider mechanism will allow the door to slide in completely opposite directions to allow an opening to either the right or the left, depending on the desires of the user. In embodiments, a sliding stopping mechanism 88 is provided; however, any conventional stopping mechanism may be used with this embodiment to ensure that the carriages do not disengage.

Figure 8B:
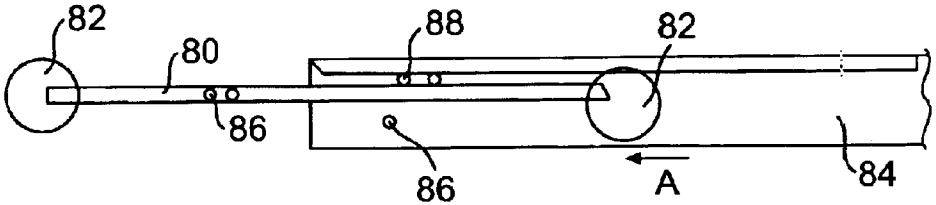
Figure 8C:
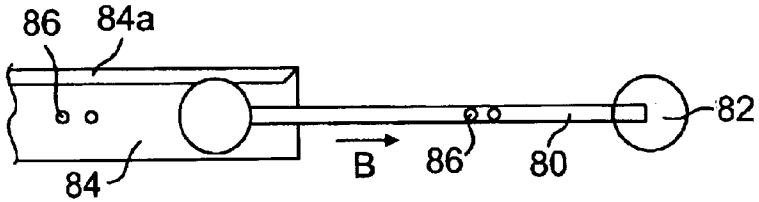

FIGS. 8*b* and 8*c* show the carriages 80 and 84 in extended, opposing positions. In FIG. 8*b*, the inner carriage 80 is extended in the direction of arrow "A". In this extended position, the stopper 88 ensures that the inner carriage 80 will not disengage from the outer carriage 84. The wheels 82 allow for a smooth sliding mechanism between the two carriages 80, 84. FIG. 8*c* also shows the mounting holes 86 of the outer carriage 84, and further shows the inner carriage extended in the direction of arrow "B". The embodiment of FIGS. 8*a*–8*c* may also include additional bearings 88 or the like for additional support when the carriages are in the extended position. It should be recognized that either of the carriages may be stationary while the other carriage is extended, and that FIGS. 8*b* and 8*c* are provided for illustrative purposes to show one embodiment of the extension of the carriages.

Figure 9A:
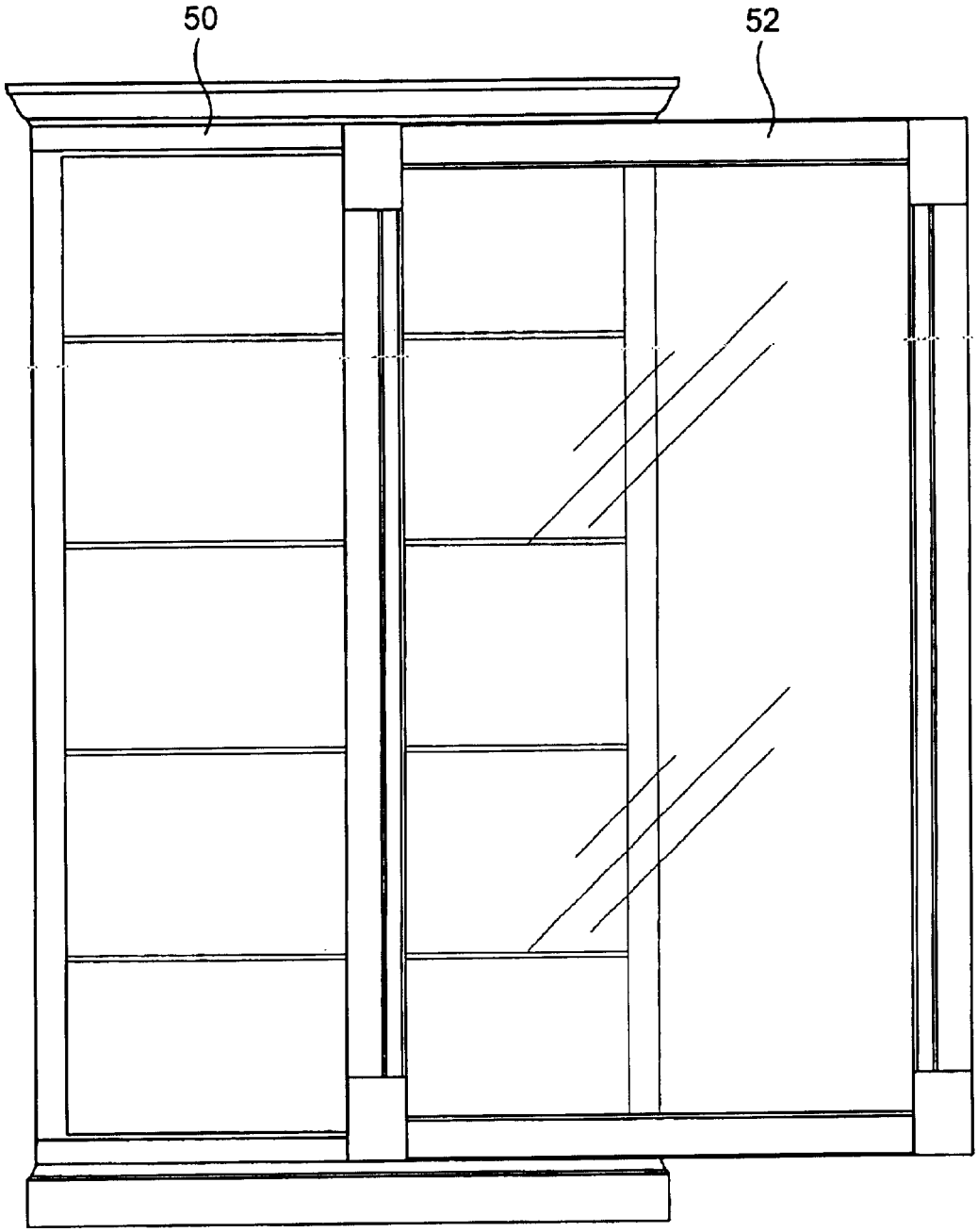
FIGS. 9*a* and 9*b* show a furniture unit in a first and second open position using the dual slider mechanism of the present invention.
Figure 9B:
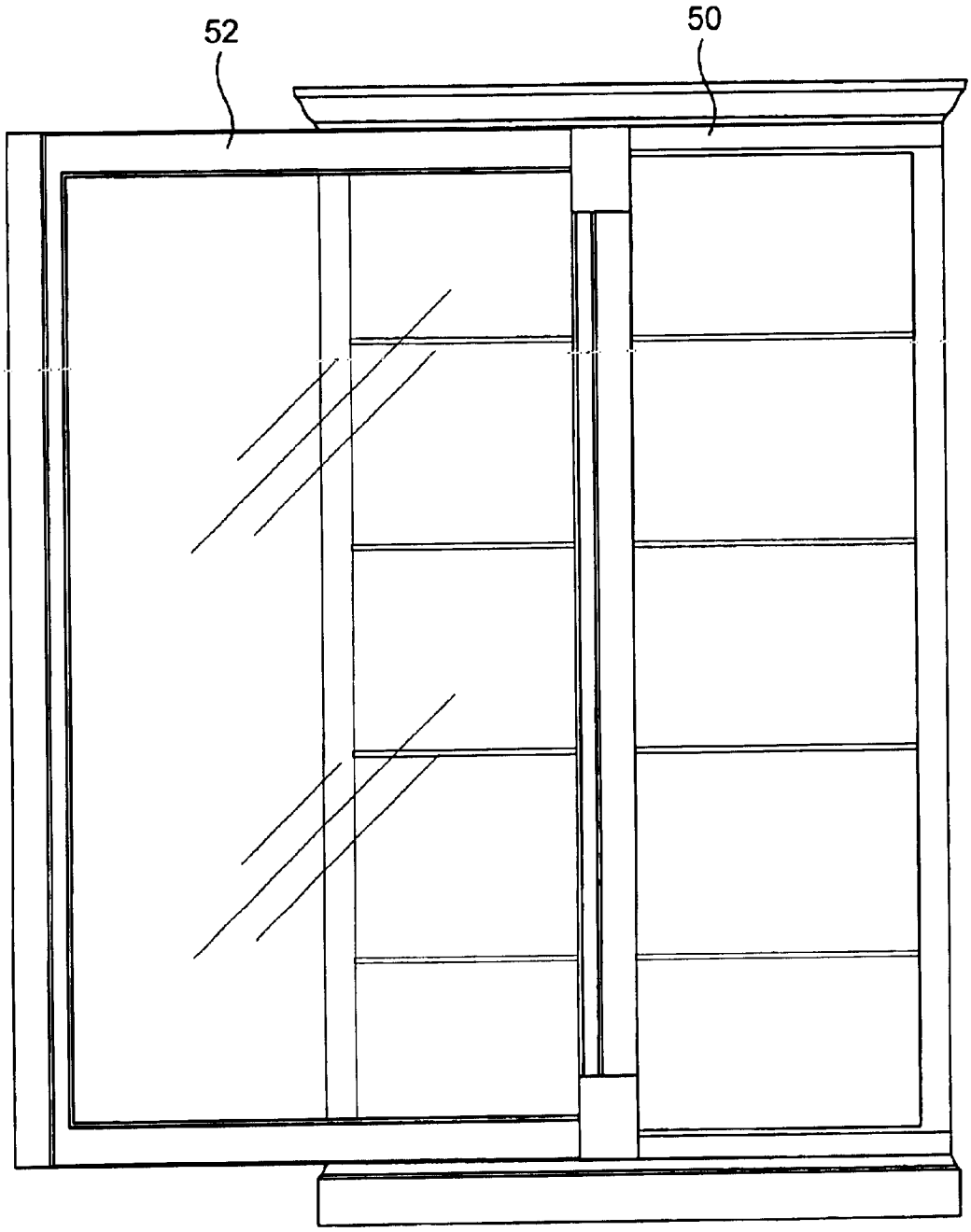

FIGS. 9*a* and 9*b* show a furniture unit using the dual slider mechanism of any of the embodiments shown. For illustrative purposes, the present invention will first be described with the use of the slider mechanism embodiment of FIGS. 1–6. However, the other embodiments of the dual slider mechanisms may equally be used with the present invention, as described below. In FIGS. 9*a* and 9*b*, it is shown that either the outer carriage 20 or the inner carriage 30 is mounted to a door 52 of a furniture unit. Likewise, the other of the outer carriage 20 or the inner carriage 30 is mounted to a frame 50 of the furniture unit. In the latter scenario, the carriage may be mounted within a recess of the frame, in embodiments. Those of ordinary skill in the art would recognize that either approach would work equally well with the present invention. FIG. 7*a* shows the door 52 in a first open position and FIG. 7*b* shows the door in a second opposing open position. In the open positions of FIGS. 7*a* and 7*b*, the dual slider mechanism would reflect the state as shown in FIGS. 5 and 6, respectively.

Figure 10:
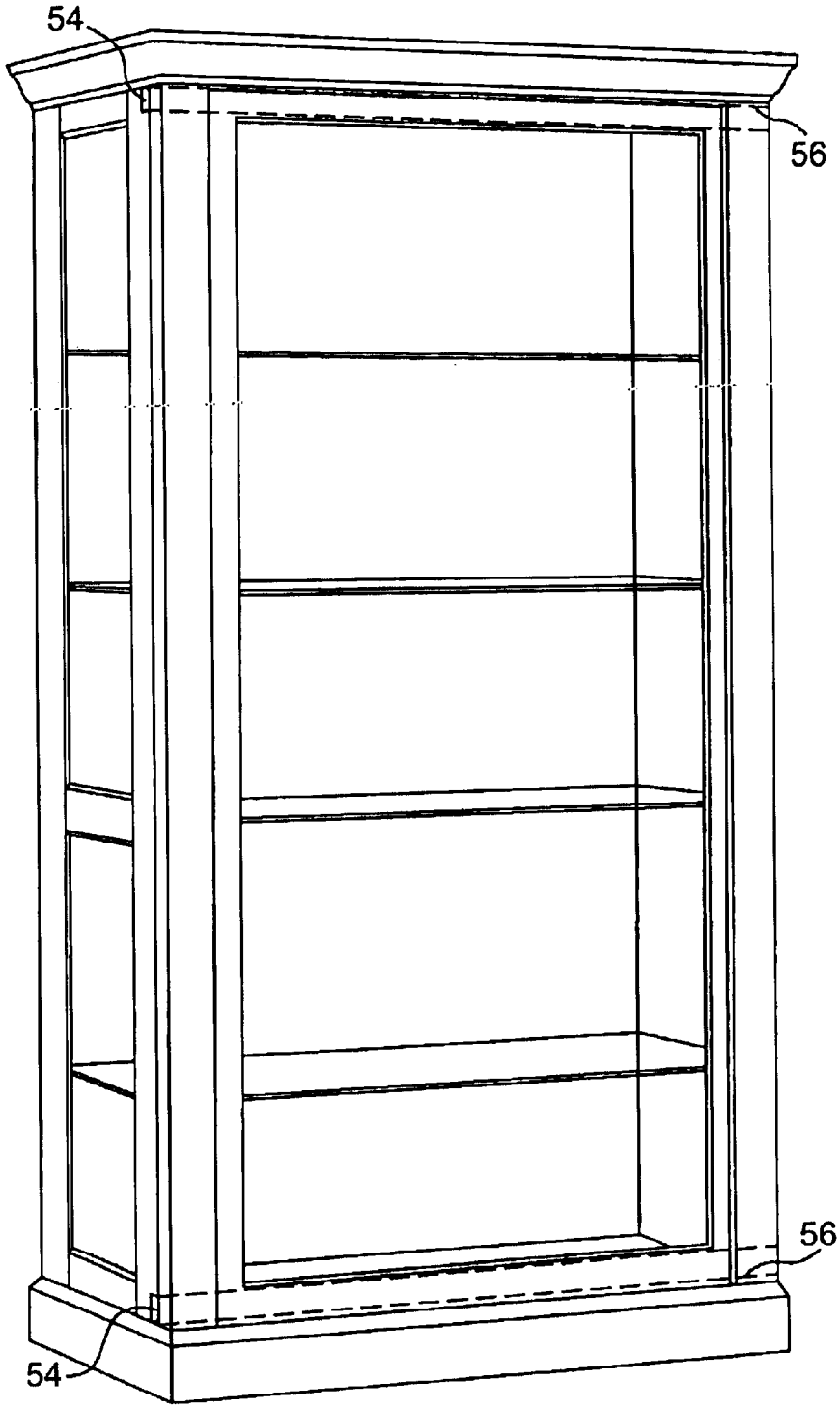
FIG. 10 shows a side view of the furniture unit with the door in the closed, center position.

FIG. 10 shows a side view of the furniture unit with the door in the closed, center position. In this position, the dual slider mechanism would reflect the state shown in FIGS. 1–3, for example (or 7*b*, 7*c* or 8*b*, 8*c*). In this view, it is seen that a notch 54 is positioned at the corners or end stile pieces of the furniture unite corresponding to the mounting position of the dual slider mechanism 10 of the present invention (with the recess in the frame, for example). It should be understood that this notch 54 is also placed at the opposing side of the furniture unit (not shown); however, the notches 54 need only be placed where the mounting of the dual slider mechanism 10 is mounted to the furniture unit. So, for example, if the dual slider mechanism 10 is mounted only on the top portion of the frame 50 and door 52, the notches 54 will only be required at the top portion of the furniture unit corresponding to the mounting position of the dual slider mechanism 10. The notches allow one of the carriages 20 or 30 to slide freely with the door of the furniture unit.

In alternative embodiments, a channel or recess 56 may be located in the door 52, itself. In this embodiment, shown as dashed lines in FIG. 10, one carriage 20 or 30 will be mounted within the recess of the door 52 and the other carriage 30 or 20 will be mounted on the frame 52, without the need for notches. The recessed portion and mounting positions of the dual slider mechanism 10 of this embodiment allows the door to freely open in both directions. This alternative embodiment may be used with any of the carriage mechanisms shown and described throughout this description.

Similarly, the dual slider mechanism of, for example, FIG. 7*a* may also be used with the present invention. In this embodiment, the inner carriage 70 may be mounted to the frame and nestled within the outer carriage 72 mounted to the door. The inner carriage 70 is received within the second carriage, which may be fixed (depending on the mounting position). In this manner, the door can be opened in the first or second completely open position or remain in the center-closed position. The wheels will enable the first and second carriage to extend between extended opposing directions (as shown in FIGS. 7*b* and 7*c*).

Likewise, the dual slider mechanism of FIG. 8*a* may used with a furniture unit of the present invention. In this embodiment, the inner carriage 80 includes ends 80*a* and 80*b*. The ends 80*a* and 80*b* are rotatably mounted to wheels 82 or the like. The wheels 82 are mounted within rails 84*a* of a outer carriage 84. The outer carriage 84 may be mounted to the frame of the furniture unit and the center carriage may be mounted to the door of the furniture unit. Of course, the inner carriage 80 may be mounted to the frame of the furniture unit and the second carriage 84 may be mounted to the door of the furniture unit. In either application, the dual slider mechanism will allow the door to slide in completely opposite directions to allow an opening to either the right or the left, depending on the desires of the user. The wheels will enable the first and second carriage to extend between extended opposing directions (as shown in FIGS. 8*b* and 8*c*). In both the embodiments of FIGS. 7*a*–7*c* and 8*a*–8*c*, stopping mechanisms may be implemented in order to ensure that the first and second carriages do not disengage and hence the door will not slide from the frame. Any known stopping mechanism known to those skilled in the art may be used for this purpose.

Figure 11:
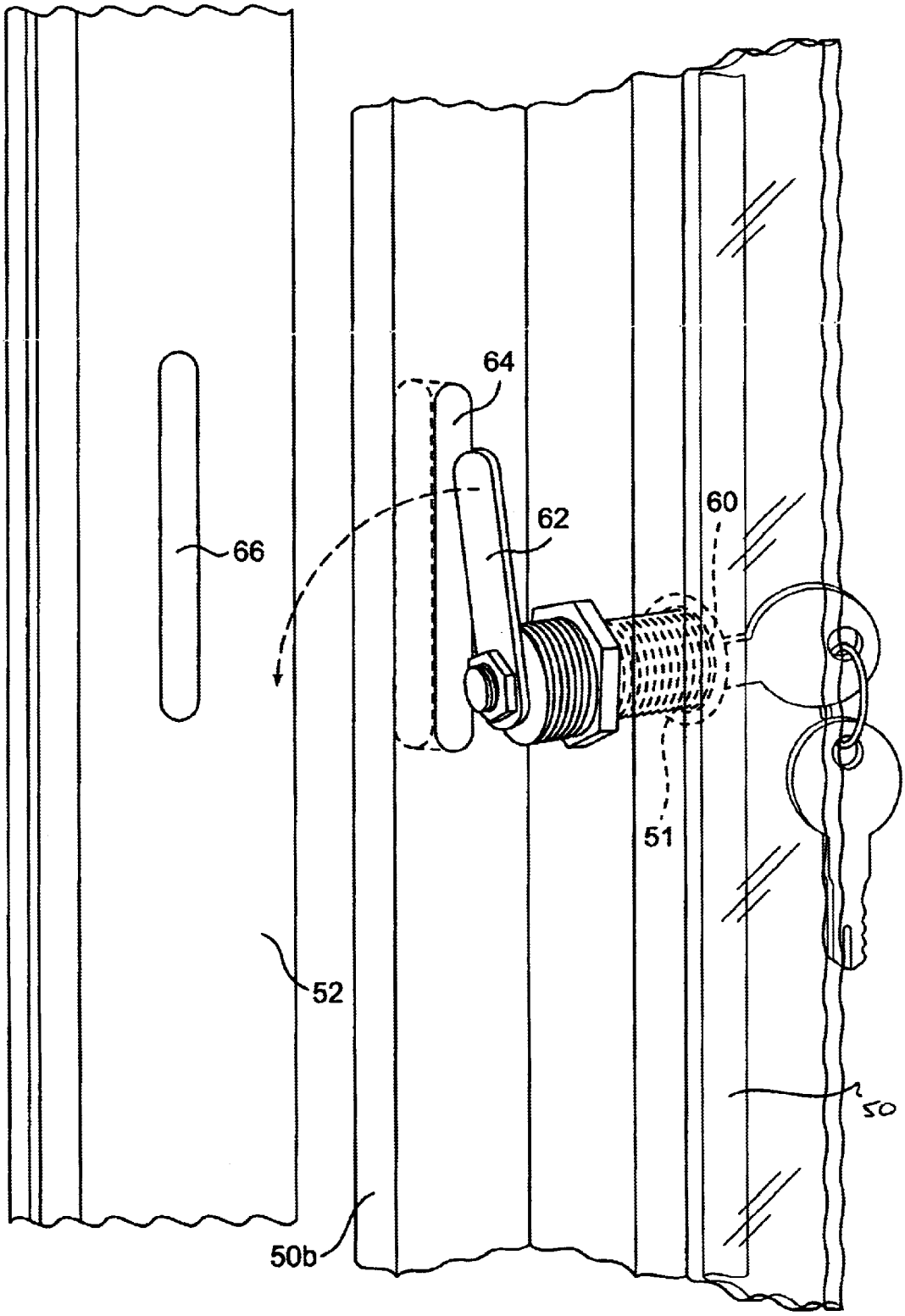
FIG. 11 shows a locking mechanism used with the furniture unit of the present invention.

FIG. 11 shows a locking mechanism of the present invention. In this embodiment, the locking mechanism includes a cylinder lock portion 60 and a rotatable blade portion 62 mounted thereto. The cylinder lock portion 60 extends though a hole 51 in the frame 50 of the furniture unit and preferably at an end frame member 50*a* of the frame 50. The frame 50 further includes a front cabinet member 50*b* that has a slot 64 corresponding to the location of the blade portion 62, substantially perpendicular to the hole 51. The blade portion 52 is capable of rotating through the slot 64 and into a slot or cavity or the like 66 of the door 52. In embodiments, the slots 64 and 66 are aligned when the door is in the closed position.

Mode of Operation

In operation, the outer and inner carriages are both moveable in opposing directions with respect to one another. In one embodiment of operation, the inner carriage may be moved in both a first or a second direction while the outer carriage remains stationary. Similarly, in another embodiment of operation, the outer carriage may be moved in both a first or a second direction while the inner carriage remains stationary. In further embodiments, both the inner carriage and the outer carriage may be moved in tandem in opposite directions. The first and second directions are parallel to the longitudinal axis of the outer and the inner carriages. An over extension or disengagement of the inner and outer carriages may be, in embodiments, prevented by the opposing stopping edges of the bearing cage contacting the stoppers of the inner rail and outer carriages. Depending on the placement of the stoppers, the inner and outer carriages may extend to a certain overall length.

When using the dual slider mechanism of the present invention, the door of the curio may be moved in either a first or second direction in order to gain access to the interior portion of the curio. In this manner, the door can be opened either to the right or the left with respect to the main cabinetry or frame of the curio. A notch is, in embodiments, provided on opposing sides of the frame of the curio at the position of the dual slider mechanism to allow the door to open and close in both directions. This notch is preferably in the frame of the curio.

While the invention has been described in terms of preferred embodiments, those skilled in the art will recognize that the invention can be practiced with modification within the spirit and scope of the appended claims.

Having thus described our invention, what we claim as new and desire to secure by Letters Patent is as follows:

1. A furniture unit comprising:

a frame having at least two notches;

a door slidably mounted between a first open position, a second opposite open position and a center closed position with respect to a frame member;

a slider mechanism mounted between the frame member and the door, the slider mechanism comprising:

a first outer carriage having upstanding side rails;

a first inner carriage slidably mounted within the upstanding side rails of the first outer carriage; and a bearing or wheel assembly slidable between the first outer carriage and the first inner carriage and adapted to slidably move the door between the first open position, the second opposite open position and the center closed position with respect to the frame member, wherein the at least two notches are aligned with a mounting position of the first outer carriage and the first inner carriage and are located in end stile portions of the frame.

2. The furniture unit of claim 1, wherein the first outer carriage includes opposing upstanding side rails of which the first inner carriage is nestled therebetween.

3. The furniture unit of claim 1, wherein:

the first outer carriage and the first inner carriage are mounted to an upper portion of the frame or the door; and the at least two notches are positioned at opposing ends of the upper portion of the frame in alignment with the first outer carriage and the first inner carriage.

4. The furniture unit of claim 1, wherein:

the first outer carriage and the first inner carriage are mounted to a bottom portion of the frame or the door; and the at least two notches are positioned at opposing ends of the bottom portion of the frame in alignment with the first outer carriage and the first inner carriage.

5. The furniture unit of claim 1, wherein stoppers are provided on at least one of the first outer carriage and the first inner carriage to prevent the door from extending beyond the first open position and the second open position.

6. The frame unit of claim 1, further comprising a recess in the frame aligned with the at least two notches and one of the first carriage and the second carriage being mounted within the recess.

7. A furniture unit comprising:

a frame having at least two notches;

a door slidably mounted between a first open position, a second opposite open position and a center closed position with respect to a frame member;

a slider mechanism mounted between the frame member and the door, the slider mechanism comprising:

a first outer carriage having upstanding side rails;

a first inner carriage slidably mounted within the upstanding side rails of the first outer carriage; and a bearing or wheel assembly slidable between the first outer carriage and the first inner carriage and adapted to slidably move the door between the first open position, the second opposite open position and the center closed position with respect to the frame member, wherein the at least two notches are aligned with a mounting position of the first outer carriage and the first inner carriage, and further comprising a second slider mechanism having a second outer carriage, a second inner carriage and a second bearing or wheel assembly slidable between the second outer carriage and the second inner carriage, wherein:

one of the first outer carriage and the first inner carriage is mounted to an upper portion of the frame and the door;

the at least two notches are four notches where two notches are positioned at opposing ends of the upper portion of the frame in alignment with the first outer carriage and the first inner carriage;

one of the second outer carriage and the second inner carriage is mounted to a bottom portion of the frame and the door; and two further notches of the four notches are positioned at opposing ends of the bottom portion of the frame in alignment with the second outer carriage and the second inner carriage.

8. The furniture unit of claim 7, further comprising two recesses formed within the frame and each of the two recesses are in alignment with the four notches and the (i) first outer carriage and the first inner carriage and one of or the (ii) second outer carriage or the second inner carriage are mounted within each of the recesses in the frame.

9. A furniture unit comprising:

a frame having at least two notches;

a door slidably mounted between a first open position, a second opposite open position and a center closed position with respect to a frame member;

a slider mechanism mounted between the frame member and the door, the slider mechanism comprising:

a first outer carriage having upstanding side rails;

a first inner carriage slidably mounted within the upstanding side rails of the first outer carriage; and a bearing or wheel assembly slidable between the first outer carriage and the first inner carriage and adapted to slidably move the door between the first open position, the second opposite open position and the center closed position with respect to the frame member; and a locking mechanism mounted between the frame and the door, the locking mechanism includes a cylinder lock portion and a rotatable blade portion mounted thereto wherein the at least two notches are aligned with a mounting position of the first outer carriage and the first inner carriage.

10. The furniture unit of claim 9, wherein the cylinder lock portion extends though a hole in the frame and the blade portion is rotatable through a slot in the frame which is substantially perpendicular to the hole.

11. The furniture unit of claim 10, wherein the door includes a means for accepting the blade portion to lock the door to the frame, the means for accepting being in substantial alignment with the slot when the door is locked to the frame.

12. A furniture unit comprising:

a frame;

a door having a recess along one of a top portion and a bottom portion, the door slidably mounted between a first open position, a second opposite open position and a center closed position with respect to a frame member;

a slider mechanism mounted between the frame member and within the recess of the door, the slider mechanism comprising:

a first outer carriage having upstanding side rails;

a first inner carriage slidably mounted within the upstanding side rails of the first outer carriage;

a bearing or wheel assembly slidable between the first outer carriage and the first inner carriage and adapted to slidably move the door between the first open position, the second opposite open position and the center closed position with respect to the frame member; and a locking mechanism mounted between the frame and the door, wherein the locking mechanism includes a cylinder lock portion and a rotatable blade portion mounted thereto.

13. The furniture unit of claim 12, wherein the first outer carriage and the first inner carriage are mounted to an upper portion of the frame or within the recess of the door.

14. The furniture unit of claim 12, wherein the first outer carriage and the first inner carriage are mounted to a bottom portion of the frame or within the recess of the door.

15. The furniture unit of claim 12, further comprising a second slider mechanism having a second outer carriage, a second inner carriage and a second bearing or wheel assembly slidable between the second outer carriage and the second inner carriage, wherein:

one of the first outer carriage and the first inner carriage is mounted to an upper portion of the frame and within the recess of the door; and one of the second outer carriage and the second inner carriage is mounted to a bottom portion of the frame and within the recess of the door.

16. The furniture unit of claim 12, wherein the cylinder lock portion extends though a hole in the frame and the blade portion is rotatable through a slot in the frame which is substantially perpendicular to the hole.

* * * * *

UNITED STATES PATENT AND TRADEMARK OFFICE

CERTIFICATE OF CORRECTION

PATENT NO. : 6,793,298 B2
DATED : July 6, 2004
INVENTOR(S) : Lindsay et al.

It is certified that error appears in the above-identified patent and that said Letters Patent is hereby corrected as shown below:

Column 2,
Line 44, please insert -- step -- after "processing".

Column 7,
Line 15, please delete "Vt" after "is a" and insert -- $V_t$ --.

Column 8,
Line 18, please delete "Vt" after "is a" and insert -- $V_t$ --.
Line 61, please delete "Vt" after "one" and insert -- $V_t$ --.
Line 65, please delete "Vt" after "any" and insert -- $V_t$ --.

Column 9,
Line 9, please delete "Vt" after "one" and insert -- $V_t$ --.
Line 26, please delete "Vt" after "at least a" and insert -- $V_t$ --.

Column 10,
Line 39, please delete "Vt" after "at least a" and insert -- $V_t$ --.

Signed and Sealed this

First Day of March, 2005

JON W. DUDAS
*Director of the United States Patent and Trademark Office*